US005405278A

United States Patent [19]

Garland

[11] Patent Number: 5,405,278

[45] Date of Patent: Apr. 11, 1995

[54] RECESS FLOW PLATE FOR A BOAT HULL

[75] Inventor: John A. Garland, Holland, Mich.

[73] Assignee: S2 Yachts, Inc., Holland, Mich.

[21] Appl. No.: 125,401

[22] Filed: Sep. 22, 1993

[51] Int. Cl.[6] ..... B63H 5/16

[52] U.S. Cl. ..... 440/69

[58] Field of Search ..... 440/66, 68, 69, 70, 440/79, 82, 83

[56] References Cited

U.S. PATENT DOCUMENTS

| | | | |
|---|---|---|---|
| 2,961,988 | 11/1960 | Wood | 440/83 X |
| 3,515,087 | 6/1970 | Stuart | 440/70 X |
| 4,300,889 | 11/1981 | Wormser | 440/69 |
| 4,832,638 | 5/1989 | Sirois | 440/83 |
| 4,941,423 | 7/1990 | Van Tassel | 440/70 X |

*Primary Examiner*—Sherman Basinger

*Attorney, Agent, or Firm*—Varnum, Riddering, Schmidt & Howlett

[57] ABSTRACT

A recess flow plate mounted to a boat hull to substantially cover a through-hull mounting recess located on the bottom of a boat hull is disclosed. The through hull mounting recess has an upstanding front wall which is adapted to receive the propeller shaft and a tapered top wall which extends rearwardly from the upstanding front wall. The flow plate is removably secured over the through-hull recess to maintain the laminar flow of water across the bottom of the boat hull.

26 Claims, 4 Drawing Sheets

RECESS FLOW PLATE FOR A BOAT HULL

BACKGROUND OF THE INVENTION

1. Field of the Invention

This invention relates to a boat hull having a recess formed in the hull thereof for receiving a driveshaft, and more particularly, to a flow plate which substantially covers the recess to maintain the surface of the boat hull.

2. Description of the Related Art

A fairly recent development in boat design is the incorporation of tapered concave tunnels formed in the boat hull immediately adjacent to the propeller. Mounting a propeller near the end of a tapering, concave tunnel on the underside of a boat hull results in more efficient propulsion from the propeller for two reasons. First, the propeller is more efficient when it rotates in non-turbulent water and the tunnel provides more efficient water flow past the propeller. Secondly, more thrust is produced because of closer alignment of the longitudinal axis of the propeller shaft, i.e. the direction of force, and the desired direction of travel, i.e. forward along the horizontal plane of the water surface.

In one prior art design, the propeller shaft extends through the hull at an acute angle with respect to the bottom surface of the boat. A fiberglass tube is mounted on the inside of the hull and receives the shaft therein. A conventional packing member is mounted at the end of the tube to control the flow of water into the boat hull through the propeller aperture. This design suffers from the expense involved in installing the fiberglass tube, properly aligning the shaft and tube and repairing the tube following a grounding or other accident.

In another prior art design, the boat comprises an inwardly projecting recess formed in the bottom surface of the boat hull. An upstanding wall of the recess has a propeller aperture formed therein which receives the propeller shaft. The internal end of the shaft is mounted to an engine and the external end of the shaft has a propeller mounted thereto. The upstanding wall of the recess provides a substantially planar surface which is suited to receive the propeller shaft and provide a suitable mounting surface on the interior of the boat hull for packing material. The packing material surrounds the shaft and controls the flow of water into the hull through the propeller aperture.

A significant problem lies in the combination of the inwardly projecting recess in the boat and concave tunnels. Namely, the inwardly projecting recess is a disruption of the surface of the boat hull thereby resulting in the creation of turbulent water flow along the boat hull to the rear of the recess. Therefore, several of the benefits achieved in enhancing the substantially laminar flow along the underside of the boat hull with the concave tunnels is lost as a result of the turbulent flow created by the recesses.

SUMMARY OF THE INVENTION

The boat according to the invention overcomes the problems of the prior art described above by creating a recess on the bottom surface of the hull adjacent the leading edge of the tunnel and mounting a flow plate to the boat hull which substantially covers the recess to maintain the surface of the boat hull. This results in maintaining the substantially laminar water flow along the boat hull.

The boat according to the invention comprises a boat hull having a bow and a stern and a bottom surface extending between the bow and the stern. An interior area is located on the opposite side of the hull from the bottom surface. An engine is mounted in the interior area of the boat hull. A through-hull mounting recess is formed in the bottom surface of the boat hull and comprises an upwardly extending wall. A propeller shaft aperture is formed in the upwardly extending wall of the through-hull mounting recess. A propeller shaft is rotatably received in the propeller shaft aperture of the recess. The shaft has a first and second end. The first end being mounted to the engine. A propeller is mounted to the second end of the propeller shaft. A flow plate is mounted to the bottom surface of the boat hull and adapted to receive the propeller shaft, substantially cover the through-hull recess and continue the contour of the bottom surface of the boat hull. A concave-tapered tunnel is formed in the boat hull and receives the propeller shaft and the propeller. The tunnel is formed between the stern of the boat and the through-hull recess. The flow of water along the bottom surface of the boat remains substantially laminar as the water flows across the flow plate and into the concave tunnel.

In one embodiment, the flow plate is adapted to substantially cover the through-hull recess and has an aperture formed therein to receive the propeller shaft.

In one embodiment, the flow plate is U-shaped and has two substantially parallel legs which receive the propeller shaft therebetween. In another embodiment, the aperture in the flow plate is elliptical.

BRIEF DESCRIPTION OF THE DRAWINGS

The invention will now be described with reference to the drawings in which.

DETAILED DESCRIPTION OF THE PREFERRED EMBODIMENTS

Figure 1:
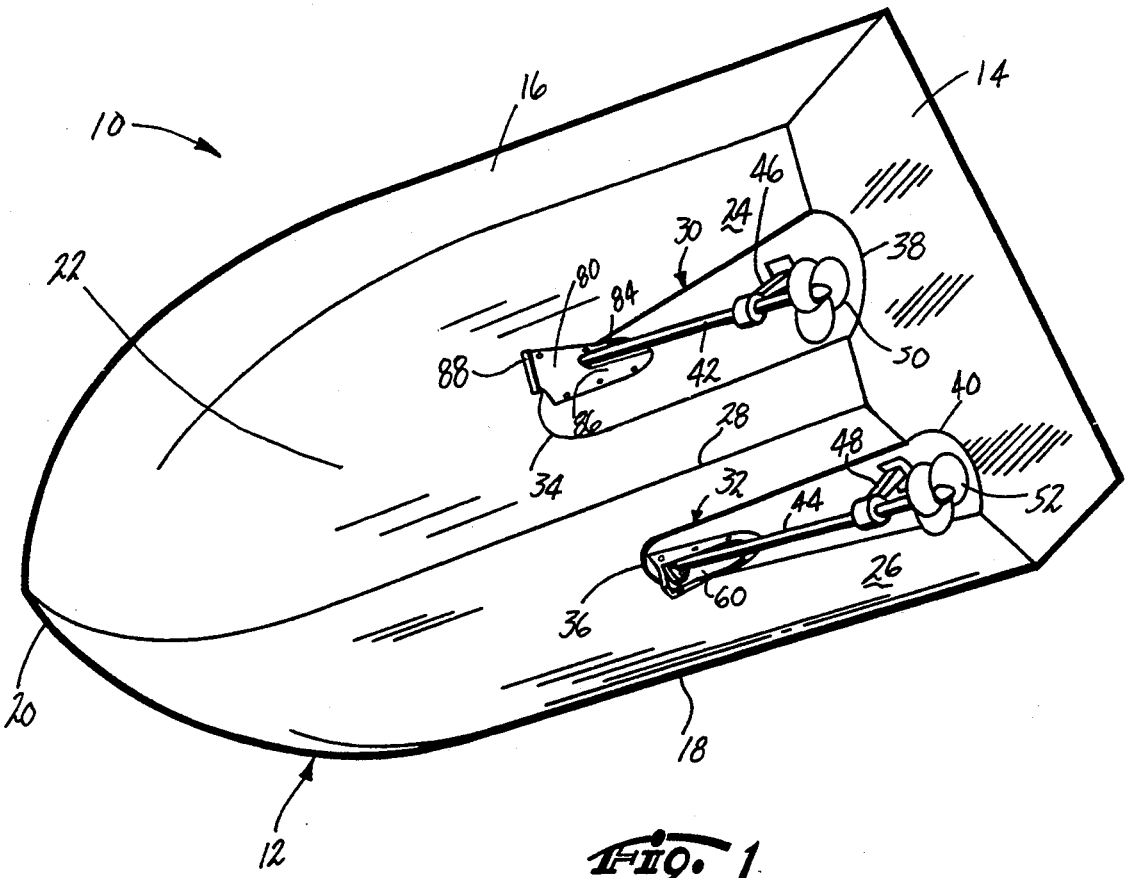
FIG. 1 is a lower, perspective view of a boat and boat hull having tapered convex tunnels and a recess flow plate according to the invention.
Figure 2:
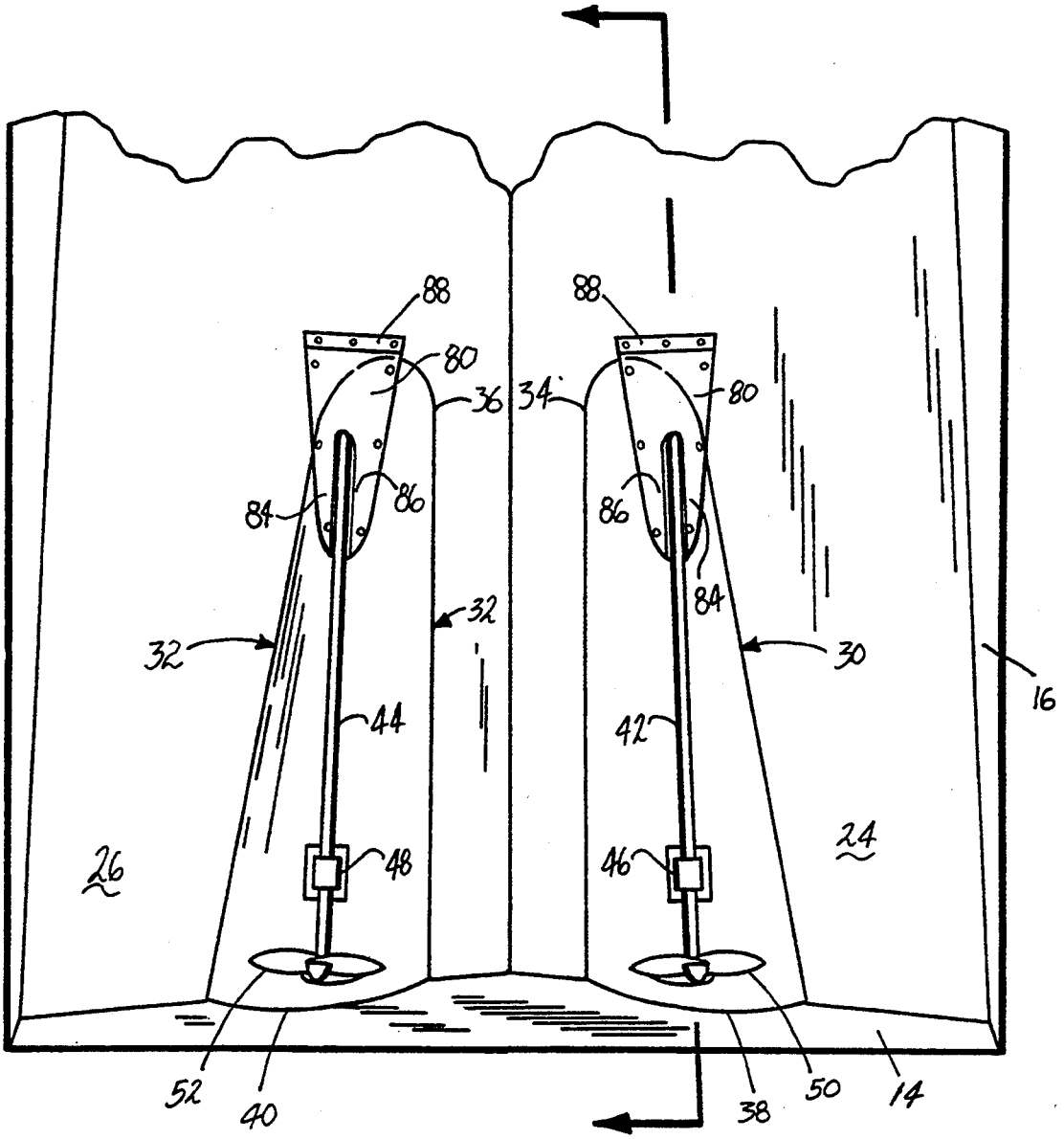
FIG. 2 is a partial bottom view of the boat of FIG. 1 showing the concave tunnel and recess flow plate according to the invention.

Referring now to the drawings and to FIG. 1 in particular, a boat 10 comprising a boat hull 12 is seen. The boat hull 12 comprises a stern 14, a pair of opposed side walls 16, 18 a tapered bow 20 and a bottom surface 22. The hull design depicted in FIG. 1 is known to those skilled in the art as a conventional V-shaped planing hull. In this design, the side walls 16, 18 extend downwardly at an acute angle with respect to a vertical plane extending upwardly from the horizontal plane of the water surface. The side walls 16, 18 meet at their lower portions thereof at sloped bottom walls 24, 26, respectively. The bottom walls 24, 26 slope further downwardly to a centerline 28.

The sloped bottom walls 24, 26 of boat hull 12 have tapered, concave tunnels 30, 32 formed therein adjacent to the stern 14. The leading edge 34, 36 of each tunnel 30, 32 is relatively narrow and is relatively shallow in concave depth. The trailing edge 38, 40 of each tunnel 30, 32 is broader and has a greater concave depth than the leading edges 34, 36. The concave depth and the width of the tunnels increases gradually from the leading edges 34, 36 to the trailing edges 38, 40.

As seen in FIGS. 1 through 4, the boat hull 12 has an inwardly projecting through-hull recess 60 formed in the bottom surface 22 of the hull 12. Preferably, a pair of through-hull recesses 60 are formed in the hull such that a portion of the recesses 60 extend into in the concave tunnels 30, 32 and a portion of the through-hull recesses 60 are formed outside of the concave tunnels 30, 32. Each recess 60 comprises an upstanding front wall 62, a tapered top wall 64 extending from the front wall 62 and a flow plate recess 66 formed in the hull 12 around the perimeter of the through-hull recess 60. The flow plate recess 66 comprises an upstanding sidewall 78 and a base wall 79. A through-hull support member 68 is mounted in the upstanding front wall 62 of the through-hull recess 60. Each support member 68 has a propeller shaft aperture 72 formed therein and bearings 70 supported in the aperture 72.

A pair of engines are mounted on the inside of the boat hull 12 and provide the force of rotation to a pair of propellers 50, 52 mounted on one end of a pair of propeller shafts 42, 44. The manner in which the two shafts 42, 44 are mounted in the boat 10 is the same and therefore the mounting structure of only one shaft 42 shall be described in detail.

Figure 3:
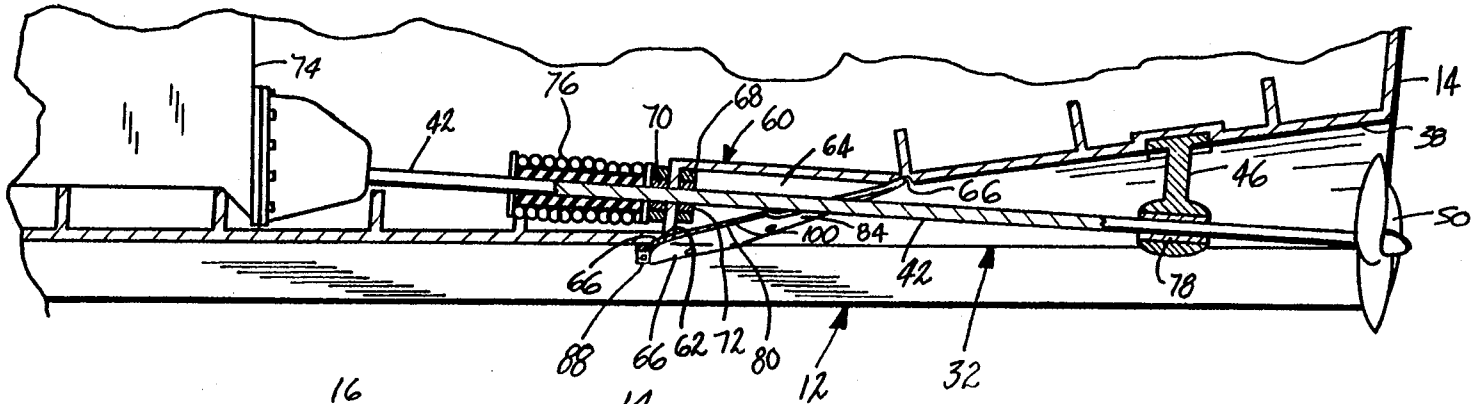
FIG. 3 is a partial sectional view of the boat and recess flow plate according to the invention taken along lines 3—3 of FIG. 2.
Figure 4:
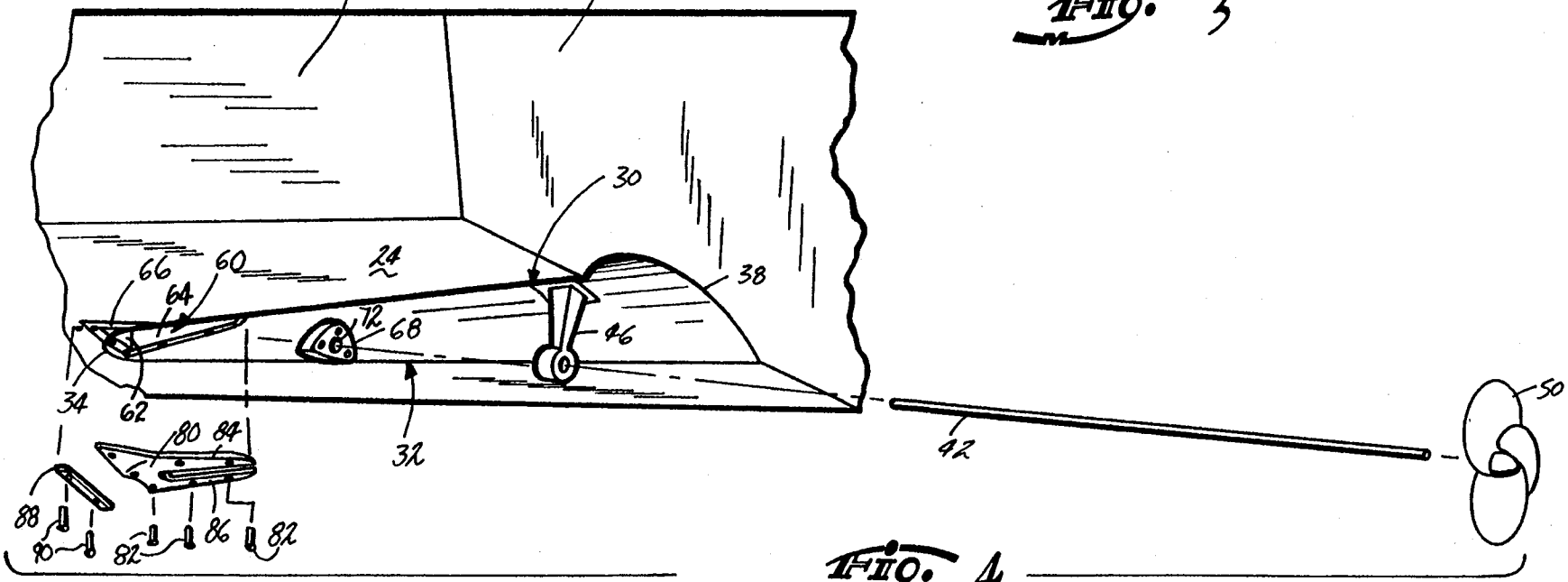
FIG. 4 is a partial exploded view of the propeller shaft and recess flow plate according to the invention.

As seen in FIG. 3 an engine 74 is mounted on the inside of the hull 12 and receives one end of the propeller shaft 42. The shaft 42 extends rearwardly from the engine 74 through the propeller shaft aperture 72 of the through-hull support member 68. The propeller shaft 42 is journaled in the bearings 70 of the through-hull support member. The shaft 42 extends rearwardly through the recess 60, into the concave tunnel 30 and is journaled in the bearings 78 of the support member 46. A propeller 50 is securely mounted at the terminal end of the propeller shaft 42 near the trailing edge 38 of the tunnel 30.

A conventional packing member 76 is mounted on the propeller shaft 42 inside of the hull 12 immediately adjacent the through-hull support member 68. The packing member 76 is adapted to create a substantially watertight seal around the propeller shaft 42 thereby preventing the flow of water into the boat 10 through the through-hull support member 68. One example of a packing member suitable for use according to the invention is a Norscott brand oil cooled dripless packing unit.

A flow plate 80 is removably mounted to the bottom 22 of the boat hull 12 by a plurality of fasteners 82. In a first embodiment shown in FIGS. 1 through 4, the flow plate 80 is received in the flow plate recess 66 which extends around the perimeter of the through-hull recess 60 and substantially covers the recess 60. The flow plate 80 is received in the recess 60 such that the interior surface of the flow plate 80 abuts the base wall 79 of the flow plate recess 66 and the exterior surface of the flow plate 80 substantially maintains the contour of the boat hull 12 in the area of the through-hull recess 60. As described above, a portion of the preferred embodiment of the through-hull recess 60 is formed in the concave tunnels 30, 32 and a portion of the through-hull recess 60 extends outside the tunnels 30, 32. Similarly, a portion of the flow plate 80 preferably extends along the bottom surface of the boat outside of the tapered tunnel 30, 32 and a portion of the flow plate 80 extends across a portion of the concave tapered tunnel 30, 32. In the first embodiment, the flow plate 80 is U-shaped and has a pair of legs 84, 86 which are received on opposite sides of the propeller shaft 42. Preferably, a stainless steel support plate 88 is removably mounted along the leading edge of the flow plate 80 by a plurality of fasteners 90 to protect the flow plate 80. The support plate 88 provides additional support and protection for the flow plate 80.

The flow plate 80 substantially covers the through-hull recess 60 and maintains the contour of the boat hull in the area of the recess 60. While water will enter the recess 60 during operation and use of the boat, the flow plate 80 preserves the substantially laminar flow of water across the bottom 22 of the boat hull 12 as the water enters the concave tunnels 30, 32. Maintaining laminar water flow across the bottom of the hull is important for the efficiency of the propulsion system. If the propellers 50, 52 rotate in turbulent water, then the propellers 50, 52 will become less efficient and may prematurely deteriorate as a result of cavitation pitting.

Figure 5:
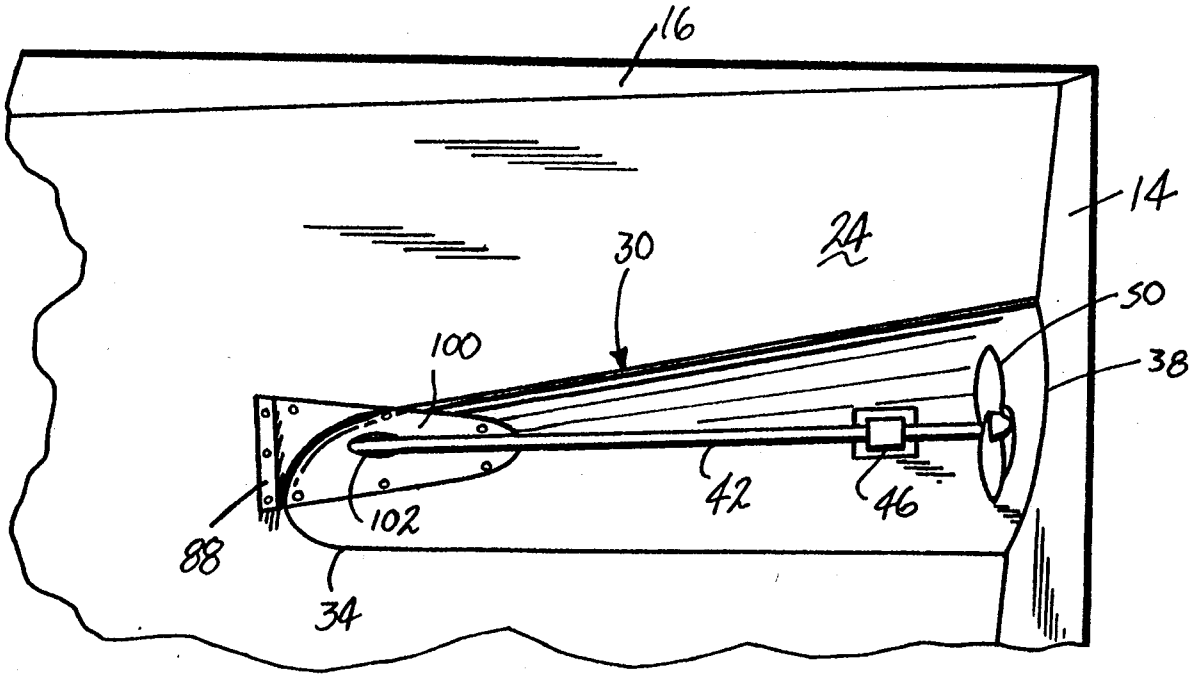
FIG. 5 is a partial bottom view of a boat having an alternative embodiment of the recess flow plate according to the invention mounted thereto.

A second embodiment of the flow plate is shown in FIG. 5. In this embodiment, the flow plate 100 has an elliptical opening 102 formed therein which is adapted to receive the propeller shaft 42.

The incorporation of the flow plate 80 on a boat according to the invention provides a significant advantage over the prior art boat designs. Namely, the incorporation of the flow plate over the recess preserves substantial laminar flow along the bottom surface of a hull having a through-hull recess formed therein. Therefore, a boat designer can now include both a through-hull recess in a boat hull and tapered concave tunnels and take advantage of the benefits of both features. Previously, this combination was not practical because all advantages of increased thrust from the propeller achieved by the increased laminar flow of the tunnel construction was lost as a result of the increased turbulent flow created by the through-hull recess.

While the boat 10 according to the invention has been described with respect to a twin-screw V-shaped planing hull, persons skilled in the art will understand that the invention can be incorporated in virtually any hull design wherein a through-hull recess is mounted to the bottom surface of the boat hull forward of the concave tunnel.

While particular embodiments of the invention have been shown, it will be understood, of course, that the invention is not limited thereto since modification may be made by those skilled in the art, particularly in light of the foregoing teachings. It is, therefore, contemplated by the appended claims to cover any modification which incorporates those features constituting the essential features of the improvements within the true spirit and scope of the invention.

The embodiments for which an exclusive property or privilege is claimed are defined as follows:

1. A boat comprising;

a boat hull having a bow and a stern and a bottom surface extending between the bow and stern, and an interior area located on the opposite side of the hull from the bottom surface;

an engine mounted in the interior area of the boat hull;

a through-hull mounting recess formed in the bottom surface of the boat hull, the recess comprising an upwardly extending wall;

a propeller shaft aperture formed in the upwardly extending wall of the through-hull mounting recess;

a propeller shaft rotatably received in the propeller shaft aperture of the recess, the shaft having a first and second end, the first end being mounted to the engine;

a propeller mounted to the second end of the propeller shaft;

a flow plate mounted to the bottom surface of the boat hull and adapted to receive the propeller shaft, substantially cover the through-hull recess and continue the contour of the bottom surface of the boat hull; and a concave, tapered tunnel formed in the boat hull which receives the propeller shaft and the propeller, the tunnel being formed adjacent the stern of the boat;

wherein the flow of water along the bottom surface of the boat remains substantially laminar as the water flows across the flow plate and into the concave tunnel.

2. A boat according to claim 1 wherein the flow plate substantially covers the through-hull recess and has an aperture formed therein to receive the propeller shaft.

3. A boat according to claim 2 further comprising a flow plate recess formed in the bottom of the boat hull about the perimeter of the through-hull recess, the flow plate recess being adapted to receive the flow plate.

4. A boat according to claim 2 wherein the flow plate is U-shaped and has two substantially parallel legs which receive the propeller shaft therebetween.

5. A boat according to claim 2 wherein the aperture in the flow plate is elliptical.

6. A boat according to claim 1 wherein the flow plate is removably mounted to the bottom surface of the boat hull.

7. A boat according to claim 6 further comprising a plurality of fasteners to removably mount the flow plate to the bottom surface of the boat hull.

8. A boat according to claim 1 wherein a portion of the through-hull recess is formed in the concave, tapered tunnel and a portion of the through-hull recess is formed in the bottom surface of the boat hull, outside of the concave tapered tunnel.

9. A boat according to claim 1 further comprising a flow plate recess formed in the bottom of the boat hull about the perimeter of the through-hull recess, the flow plate recess being adapted to receive the flow plate.

10. A boat according to claim 9 wherein the flow plate further comprises an exterior surface and an interior surface opposite the exterior surface, the flow plate recess comprising an upstanding side wall and a base wall, the flow plate being received in the flow plate recess such that the interior surface of the flow plate abuts the base wall of the flow plate recess and the exterior surface of the flow plate creates a continuous surface with the area of the bottom surface surrounding the through-hull recess.

11. A boat according to claim 1 wherein the flow plate is contoured and extends across a portion of the concave tapered tunnel, across a portion of the bottom surface outside the tapered tunnel and the contour of the flow plate continues the shape and contour of the concave tapered tunnel and the bottom surface.

12. An improved boat comprising a boat hull having a bow and a stern and a bottom surface extending between the bow and stern, an interior area located on the opposite side of the hull from the bottom surface, an engine mounted in the interior area of the boat hull, a propeller shaft having one end mounted to the engine and a propeller mounted at the other end, the improvement comprising;

a through-hull mounting recess formed in the bottom surface of the boat hull, the recess comprising an upwardly extending wall;

a propeller shaft aperture formed in the upwardly extending wall of the through-hull mounting recess, the aperture being adapted to receive the propeller shaft;

a flow plate mounted to the bottom surface of the boat hull and adapted to receive the propeller shaft, substantially cover the through-hull recess and continue the contour of the bottom surface of the boat hull; and a flow plate recess formed in the bottom surface of the boat hull about the perimeter of the through-hull recess, the flow plate recess being adapted to receive the flow plate;

wherein the flow of water along the bottom surface of the boat remains substantially laminar as the water flows across the flow plate.

13. An improved boat according to claim 12 wherein the flow plate substantially covers the through-hull recess and has an aperture formed therein to receive the propeller shaft.

14. An improved boat according to claim 13 wherein the flow plate is U-shaped and has two substantially parallel legs which receive the propeller shaft therebetween.

15. An improved boat according to claim 13 wherein the aperture in the flow plate is elliptical.

16. An improved boat according to claim 13 wherein the flow plate is removably mounted to the bottom surface of the boat hull.

17. An improved boat according to claim 16 further comprising a plurality of fasteners to removably mount the flow plate to bottom surface of the boat hull.

18. An improved boat according to claim 12 further comprising a concave, tapered tunnel formed in the boat hull which receives the propeller shaft and the propeller, the tunnel being located adjacent the stern of the boat.

19. An improved boat according to claim 18 wherein at least of portion of the through-hull recess is formed in the concave, tapered tunnel.

20. An improved boat according to claim 18 wherein the flow plate is contoured and at least a portion of the flow plate is received in the concave, tapered tunnel, a portion of the flow plate extends along the bottom surface of the boat outside of the tapered tunnel and the contour of the flow plate continues the shape and contour of the concave tapered tunnel and the bottom surface.

21. A boat comprising;

a boat hull having a bow and a stern and a bottom surface extending between the bow and stern, and an interior area located on the opposite side of the hull from the bottom surface;

an engine mounted in the interior area of the boat hull;

a through-hull mounting recess formed in the bottom surface of the boat hull, the recess comprising an upwardly extending wall;

a propeller shaft aperture formed in the upwardly extending wall of the through-hull mounting recess;

a propeller shaft rotatably received in the propeller shaft aperture of the recess, the shaft having a first and second end, the first end being mounted to the engine;

a propeller mounted to the second end of the propeller shaft;

a concave, tapered tunnel formed in the boat hull which receives the propeller shaft and the propeller, the tunnel being formed between the stern of the boat and the through-hull recess;

a flow plate mounted to the bottom surface of the boat hull such that the flow plate extends along a portion of the bottom surface and the flow plate extends along a portion of the concave, tapered tunnel, the flow plate being adapted to receive the propeller shaft, substantially cover the through-hull recess and continue the contour of the bottom surface of the boat hull and the concave, tapered tunnel; and a flow plate recess formed in the bottom surface of the boat hull about the perimeter of the through-hull recess, the flow plate recess being adapted to receive the flow plate;

wherein the flow of water along the bottom surface of the boat remains substantially laminar as the water flows across the flow plate and into the concave tunnel.

22. A boat according to claim 21 wherein the flow plate further comprises an exterior surface and an interior surface opposite the exterior surface, the flow plate recess comprising an upstanding side wall and a base wall, the flow plate being received in the flow plate recess such that the interior surface of the flow plate abuts the base wall of the flow plate recess and the exterior surface of the flow plate creates a continuous surface with the area of bottom surface surrounding the through-hull recess.

23. A boat according to claim 21 wherein the flow plate is U-shaped and has two substantially parallel legs which receive the propeller shaft therebetween.

24. A boat according to claim 21 and further comprising an elliptical aperture formed in the flow plate to receive the propeller shaft.

25. A boat according to claim 21 wherein the flow plate is removably mounted to the bottom surface of the boat hull.

26. A boat according to claim 25 and further comprising a plurality of fasteners to removably mount the flow plate to the bottom surface of the boat hull.

* * * * *